US009057589B2

(12) United States Patent
Laporte et al.

(10) Patent No.: US 9,057,589 B2
(45) Date of Patent: Jun. 16, 2015

(54) TARGET LAUNCHING DEVICE

(75) Inventors: Jean-Michel Laporte, Biot (FR); Jean-Marc Fouques, Claviers (FR)

(73) Assignee: Laporte Holding, Biot (FR)

( * ) Notice: Subject to any disclaimer, the term of this patent is extended or adjusted under 35 U.S.C. 154(b) by 170 days.

(21) Appl. No.: 13/696,276

(22) PCT Filed: May 3, 2011

(86) PCT No.: PCT/EP2011/057076

§ 371 (c)(1),
(2), (4) Date: Jan. 18, 2013

(87) PCT Pub. No.: WO2011/138342

PCT Pub. Date: Nov. 10, 2011

(65) Prior Publication Data

US 2013/0112181 A1 May 9, 2013

(30) Foreign Application Priority Data

May 5, 2010 (FR) ..... 10 53487

(51) Int. Cl.

| | |
|---|---|
| ***F41J 9/18*** | (2006.01) |
| ***F41J 9/32*** | (2006.01) |
| ***F41B 3/04*** | (2006.01) |
| ***F41J 9/20*** | (2006.01) |
| ***F41J 9/24*** | (2006.01) |
| ***F41J 9/30*** | (2006.01) |

(52) U.S. Cl.

CPC .... *F41J 9/18* (2013.01); *F41J 9/20* (2013.01); *F41J 9/24* (2013.01); *F41J 9/30* (2013.01); *F41J 9/32* (2013.01); *F41B 3/04* (2013.01)

(58) Field of Classification Search

CPC ..... F41J 9/18; F41J 9/30; F41J 9/32; F41B 3/04

USPC ..... 124/6, 7, 8, 9, 26, 81

See application file for complete search history.

(56) References Cited

U.S. PATENT DOCUMENTS

| | | | | | |
|---|---|---|---|---|---|
| 488,827 | A | * | 12/1892 | Melius | 124/16 |
| 1,552,191 | A | * | 9/1925 | Bahlmann | 124/26 |
| 1,638,283 | A | * | 8/1927 | Bahlmann | 124/26 |
| 2,934,056 | A | * | 4/1960 | Lauterbach | 124/9 |
| 3,246,642 | A | * | 4/1966 | Cleveland | 124/8 |

(Continued)

FOREIGN PATENT DOCUMENTS

| | | |
|---|---|---|
| FR | 2587473 | 3/1987 |
| GB | 1200093 | 7/1970 |

OTHER PUBLICATIONS

International Search Report from the European Patent Office dated Jun. 28, 2011, for International Patent Application No. PCT/EP2011/057076, filed May 3, 2011, Applicant, Laporte Holding. (6 pages).

(Continued)

*Primary Examiner* — Melba Bumgarner
*Assistant Examiner* — Alexander Niconovich
(74) *Attorney, Agent, or Firm* — McCracken & Gillen LLC

(57) ABSTRACT

A target launching device comprising a surface supporting a target to be launched and a rotary launch arm capable of applying a launch force on the target, characterized in that the supporting surface has a concave longitudinal profile located in a plane parallel to the rotation plane of the launch arm. The invention is particularly suitable for launching archery targets.

16 Claims, 5 Drawing Sheets

(56) References Cited

U.S. PATENT DOCUMENTS

| | | | | |
|---|---|---|---|---|
| 5,036,828 | A * | 8/1991 | Heffer | 124/47 |
| 5,050,575 | A * | 9/1991 | Killion | 124/8 |
| 5,265,583 | A * | 11/1993 | Otto | 124/81 |
| 5,720,664 | A * | 2/1998 | Brubacher | 463/52 |
| 5,857,451 | A * | 1/1999 | Ciluffo et al. | 124/6 |
| 6,026,796 | A * | 2/2000 | LaPorte et al. | 124/7 |
| 6,176,229 | B1 * | 1/2001 | Patenaude | 124/8 |
| 6,276,350 | B1 * | 8/2001 | Davey | 124/8 |
| 2008/0073849 | A1 * | 3/2008 | Quinn et al. | 273/362 |
| 2012/0138034 | A1 * | 6/2012 | Whidborne | 124/8 |

OTHER PUBLICATIONS

European Patent Office Written Opinion for International Patent Application No. PCT/EP2011/057076, filed May 3, 2011, Applicant, Laporte Holding (4 pages).

English translation of European Patent Office Written Opinion for International Patent Application No. PCT/EP2011/057076, filed May 3, 2011, Applicant, Laporte Holding (5 pages).

* cited by examiner

Figure 1
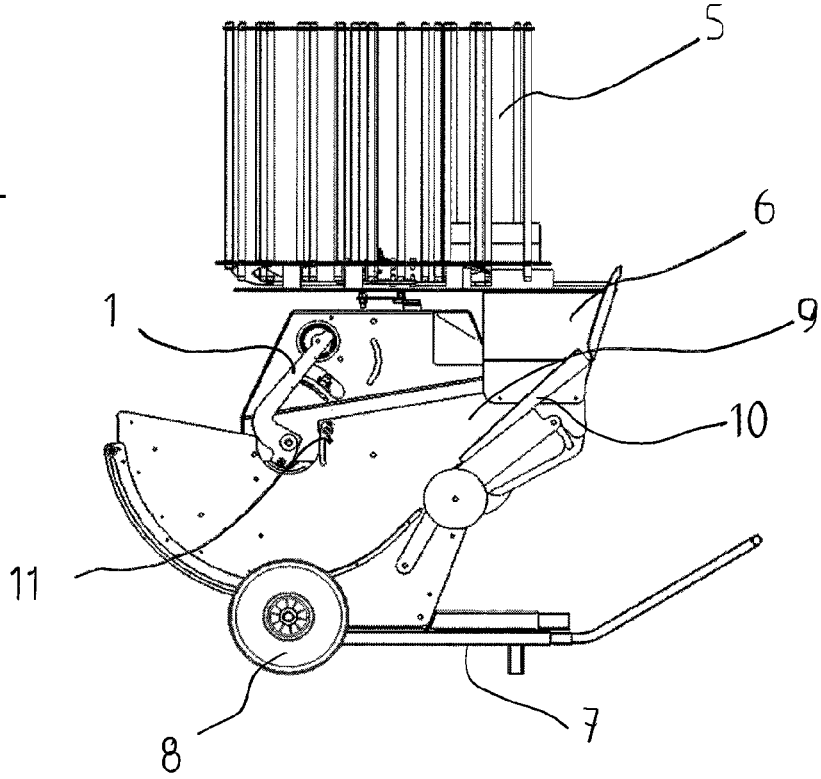
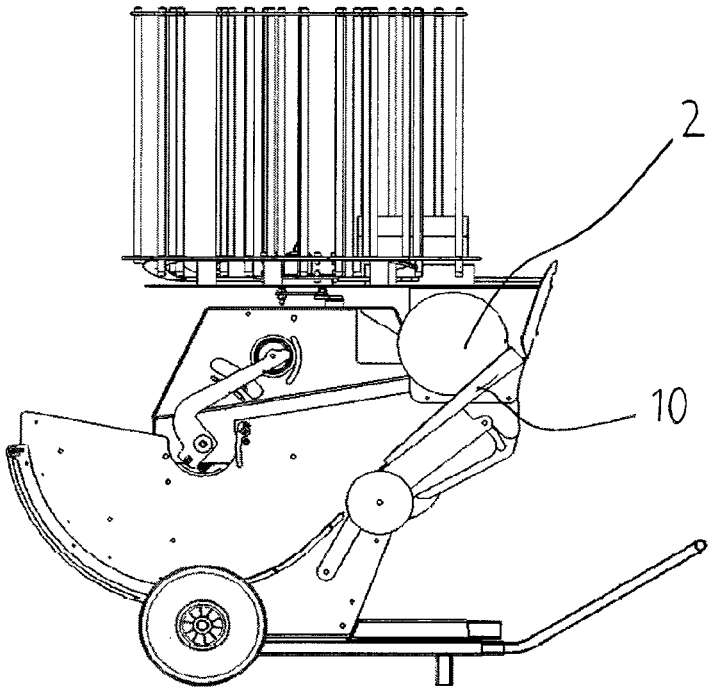
Figure 2

TARGET LAUNCHING DEVICE

This invention relates to a device for launching targets and is particularly applicable for launching archery targets.

This latter discipline has only developed recently and traditionally offers archers the opportunity to test theft accuracy skills on stationary targets. There are other devices for launching targets that are particularly suitable for launching clay pigeon type targets. These devices generally comprise a rotary arm for launching a target. The target is placed on a substantially horizontal plate prior to its launch.

There is a need to improve the co-action between the launch zone of the device and the target. Another problem with existing machines is that their adjustment is particularly complex and it is often impossible to change the trajectory of the target Document U.S. Pat. No. 1,552,192 describes a device for launching targets. Part of the device on that the target is in contact with on launching is mobile. The purpose of this mobility is to alter the launch angle of the target. The movement of this part takes place by pivoting.

Document FR-A1-2.587.473 relates to a target launching device comprising a wheel rotatably mounted above a launching ramp into which the targets are introduced vertically. The wheel seizes the targets one by one and launches them. The ramp is fixed and substantially straight, the target being launched close to the ground.

The present invention overcomes all or part of the disadvantages of the techniques known at present in target launching.

In particular, one purpose of the invention is to construct a target launching device with an improved launching zone with specific contact between the target and a supporting surface, in combination with a relative position of the particular launching arm.

Another purpose of the invention is to allow adjustment of the target trajectory using easily adjustable means. In particular, according to a preferred embodiment, the target exit angle can be adjusted simply by moving a small and lightweight part without requiring for example a large part of the device to be mobile and for example the target storage system, also called cylinder.

Other aims and advantages will become apparent from the following description of a preferred embodiment of the invention, which is not restrictive.

Before giving this detailed description, it is to be remembered that the invention concerns a device for launching targets with a surface supporting the target to be launched and a rotary launching arm able to apply a launch force to the target, characterized by the fact that the supporting surface has a concave longitudinal profile and is situated in a plane parallel to the rotational plane of the launch arm.

Below are the advantageous embodiments which may be combined or executed alternately and are not restrictive of the invention:

it comprises means for changing the length of the longitudinal profile.

the longitudinal profile is an arc of a circle.

the arc of circle is centred on the rotational axis of the arm.

the supporting surface comprises a first portion formed on a base part and a second portion formed on a support, the support being adjustable in position relative to the base part so as to modify the supporting surface.

the support is adjustable by rotation on the centre of the arc of circle configured in order to modify the overlapping surface of the first and second parts.

the overlapping surface has a range of adjustment corresponding to an angular sector of between 30 the 90°.

the first portion is positioned upstream of the second portion relative to the direction of rotation of the launching arm.

the downstream end of the first portion relative to the direction of rotation of the launching arm forms a tangent relative to the first substantially horizontal length.

the support is a flap comprising a side in a plane that is oblique relative to the second portion.

the support is a carriage mounted to be adjustable in a slide relative to the base part.

the slide is formed on the one hand on the base part and on the other on a side wall that is substantially parallel to the base part.

it comprises at least one target of circular cross-section, the edge of which is configured to bear on the supporting surface.

the target is made of plastic.

The accompanying drawings are given as examples and do not limit the invention. They represent only one embodiment of the invention and will enable it to be easily understood.

FIG. 1 shows a partial longitudinal section of the launch device in a preferred embodiment.

FIGS. 2 and 3 show similar views with target loading phases.

Figure 3:
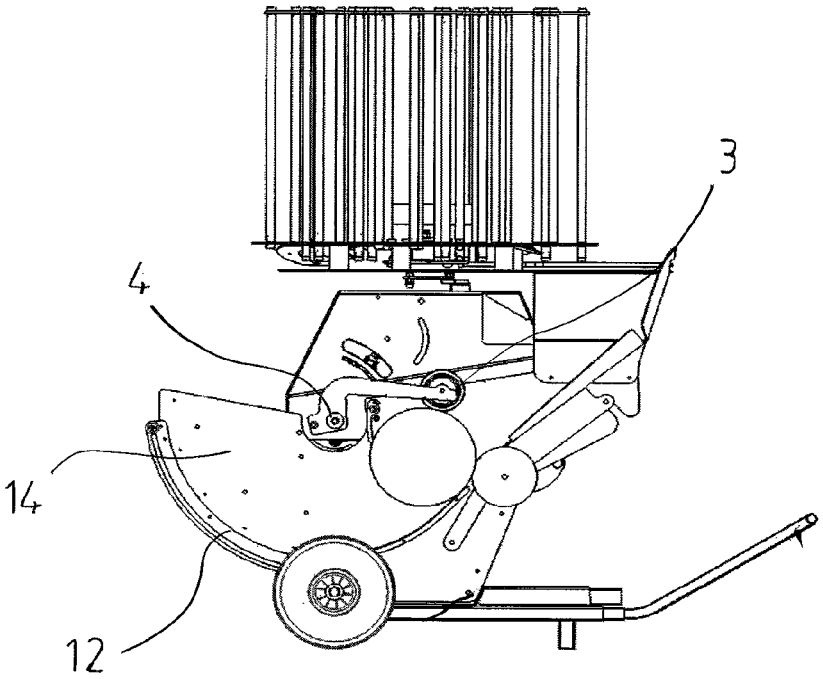

With reference to FIG. 1, it will be noted that the invention device may comprise a base 7 that can be a welded metal structure, although this is only one possibility for illustrative purposes, and can be equipped with gripping means such as a handle, and the wheel 8. The launching assembly is fitted on the base and comprises a launching arm 1 mounted to rotate around an axis 4. In the example shown, the axis 4 is substantially horizontal. Conventional actuating means may be used to apply a rotational force to the launch arm 1. Thus, the launch arm 1 is able to coact with a spring tensioned by a motor and able to release on receiving an order to launch the target 2.

The latter, although this is not restrictive, is advantageously of the plate type with substantially flattened cylindrical shape made of a plastic material and more especially in one or several layers of a polymer foam. The preferred circular shape of the target 2 enables it to roll on a supporting surface such as described in detail below.

Above the launch area is a cylinder 5 which, in the case shown, allows successive loading and launching of targets 2. As is known for clay pigeon devices, the cylinder 5 shown comprises several parallel rods defining substantially cylindrical volumes for receiving the superimposed targets 2. The cylinder 5 is driven rotationally by separate means or coupled with means driving the launch arm so that when it is required to launch a target, the cylinder 5 is actuated rotationally in order to deliver a target 2 in the direction of the launch zone close to the arm 1. Thus, in the example shown in FIG. 1, the cylinder 5 is positioned on top of an sloping ramp 6 in order to deliver a target from the cylinder 5 to a loading zone 9 from which the target 2 can descend along a chute 10 up to a stop 11 which prevents its further descent.

It will be easily understood that at this stage the launch arm 1 is able to be actuated so as to launch the target 2 thus positioned. In the example shown, the launch arm 1 comprises at its distal end a roller 3 of substantially circular section and preferably mounted pivotally relative to the remainder of the launch arm 1 so as to bear on the target while retaining a freedom of rotational movement of its own.

According to the invention, a supporting surface 12 is provided in order to accompany the launch movement of the target 2. To this end, the supporting surface 12 is positioned below the launch arm 1 and is configured to receive a target 2 on its edge. The supporting surface 12 has a longitudinal profile (that is to say, oriented in the same direction as the views in FIGS. 1 to 9, in a plane transversal to the rotational axis 4 of the launch arm). The concave longitudinal profile has a cradle-like shape so as to accommodate target 2 and guide it through its launch movement and ensure a smooth guiding motion. The supporting surface is preferably an arc of a circle. Moreover, in order to maintain a constant distance between the distal end of the launch arm 1 and the supporting surface 12, the arc in question is preferably centred on the axis of rotation 4. This is given as an example. In particular, the target can be offset if it is required to vary the rotational effects.

The width of the supporting surface 12 is not limited but is preferably equal to or slightly wider than the thickness of the edge of the target 2.

Below is described an advantageous embodiment of the supporting surface 12. As shown in the various figures, the apparatus comprises a base part 13 having a side 14 oriented substantially perpendicular to the surface 12 so as to form a boundary surface limiting the deflection of the target 2 on the supporting surface 12. In addition, the base part 13 constitutes a first portion of the supporting surface 12. Advantageously, said first portion is located upstream of a second portion in the direction of rotation of the launch arm when in the launch phase. Thus, the first portion formed in the base part 13 constitutes the first supporting component which receives the target 2 when it is launched. The support continues with a second portion formed in another part, for example a flap 15 in this case. The illustrated flap 15 comprises a part of side 16 oriented opposite side 14 of base part 13 so as to constitute a boundary limiting the movement of the target 2 by the face of target 2 opposing the face opposite the side 14. In addition, flap 15 comprises the second portion that contributes to forming the supporting surface 12.

In the case shown, flap 15 is able to move in rotation relative to base part 13 which, in the example, is fixed in relation to the base 7 of the launch device. The rotational movement ensures that the relative position of the flap 15 and the base part 13 can be adjusted. More specifically, these two constituent parts of the device may be fitted together with a variable range of rotation so as to change their overlapping surface at the supporting surface 12. In other words, the supporting surface 12 can be shortened by moving the flap 15 and superposing a section of the second portion of the supporting surface 12 (preferably by passing it under the first portion of the supporting surface 12) so that it overlaps the base part 13. By changing the overlapping surface of the two portion of the supporting surface, the configuration and the target angle exit are altered.

All the flap 15 rotational adjustment means are part of the invention. For example, the flap 15 is fitted to pivot around an axis that is preferably parallel and even identical to the rotational axis 4 of the launch arm 1. In addition, means are provided for stopping the rotation of the flap 15 so as to render it immobile when reaching the required angular position of the flap 15.

Figure 4:
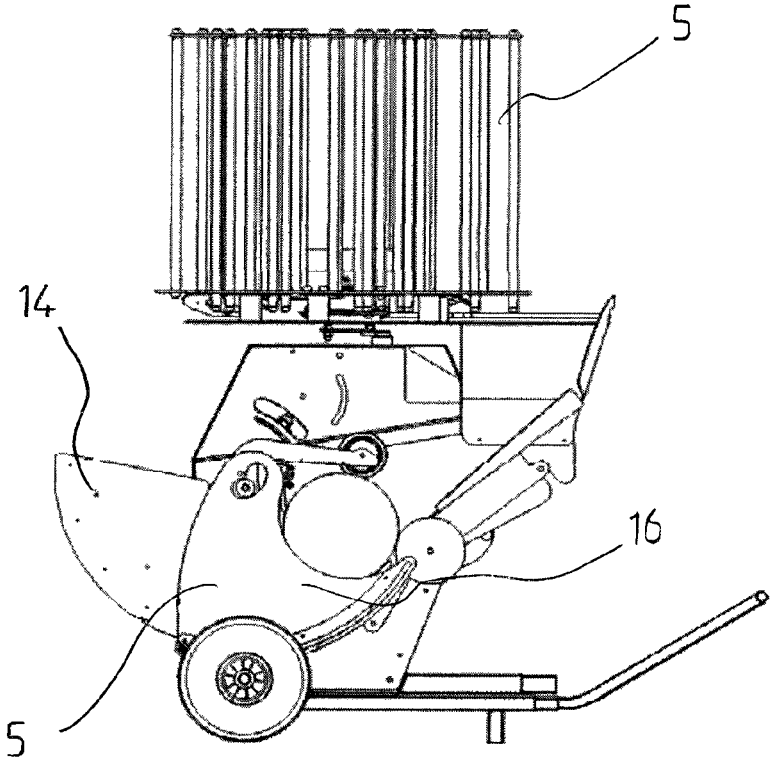
FIGS. 4 and 5 show two side views of the device, with a flap for adjusting the supporting surface of the target in a first position.
Figure 5:
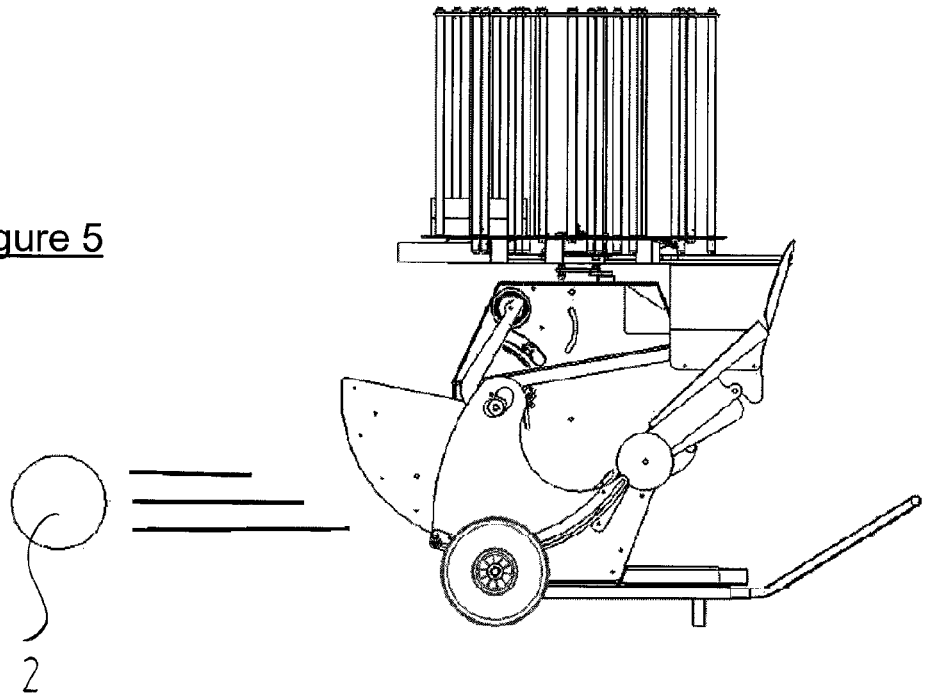

FIG. 4 shows the angular position of the flap 15 in which the latter is essentially folded down around the base part 13 so that the first and second sections of the supporting surface largely overlap. In these conditions, when receiving the target 2, the supporting surface 12 essentially consists of the first portion situated on the base part 13. This reduces the arc of circle of the supporting surface and the target 2 is launched, as shown in FIG. 5, in a substantially horizontal direction, it being stated here that the illustrated embodiment ensures that the downstream end of the first portion of the supporting surface 12 on the base part 13 is substantially opposite the launching arm 1 when in a vertical position, or so that the tangent to the arc of circle at the downstream end is substantially horizontal. In this way, the target 2 is launched substantially horizontally.

Figure 6:
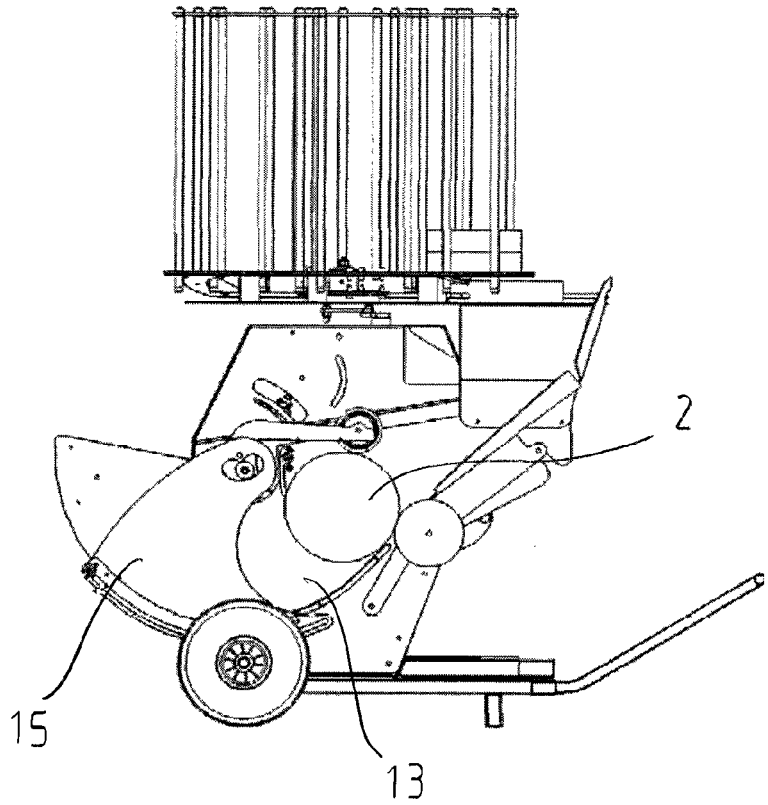
FIGS. 6 and 7 show similarly a side view of the device with the flap in a second position.
Figure 7:
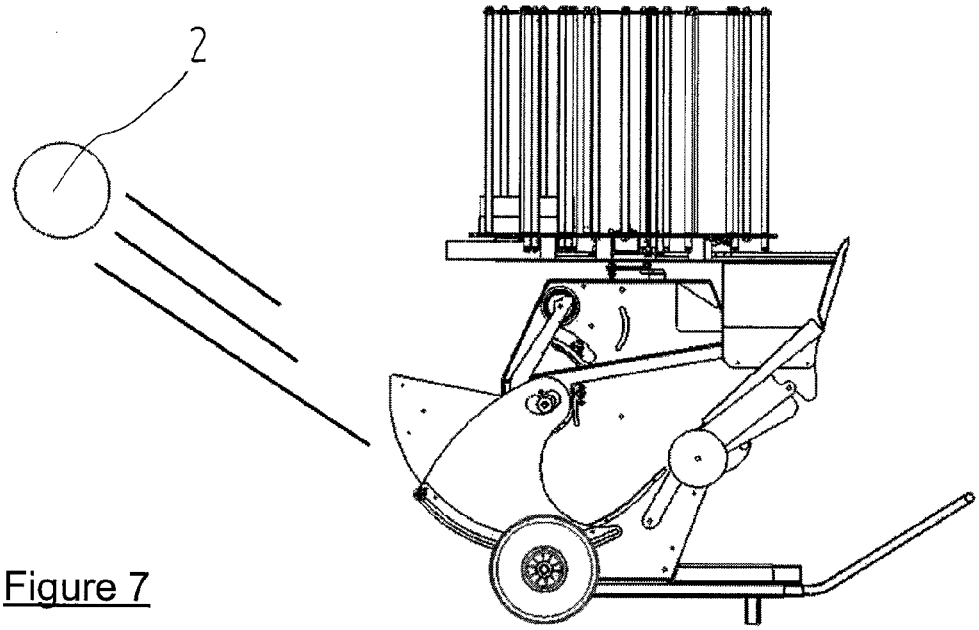

FIG. 6 shows another possible position of the flap 15, turned slightly clockwise so as to increase the size of the supporting surface 12. It will be understood that the target 2 bears longer on the supporting surface 12 since this is increased by the second portion located on the flap 15. Thus, this changes the launch direction as shown in FIG. 7.

Figure 8:
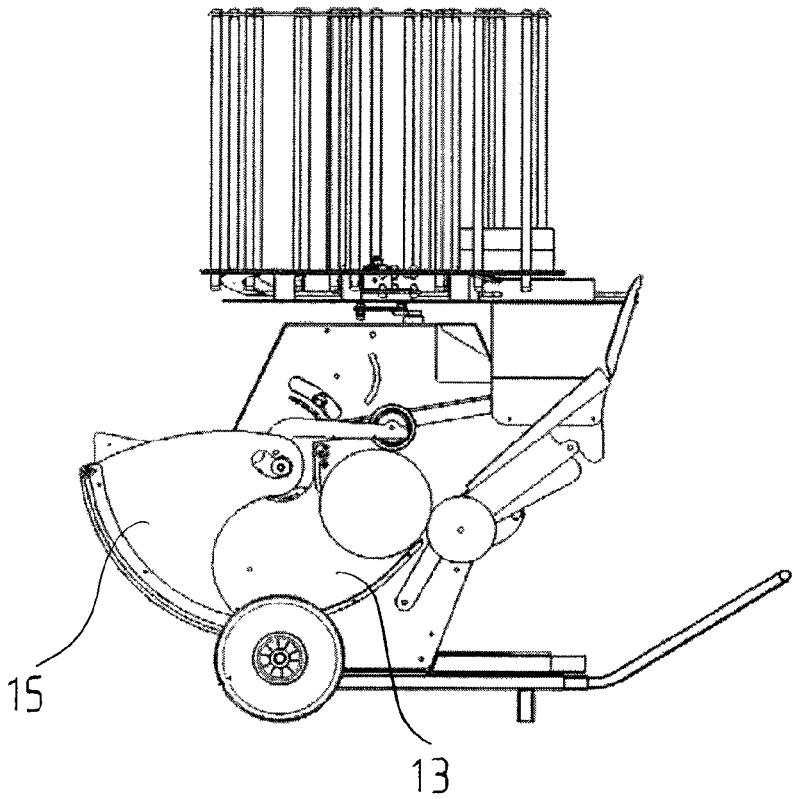
FIGS. 8 and 9 show corresponding views with a flap in a third position.
Figure 9:
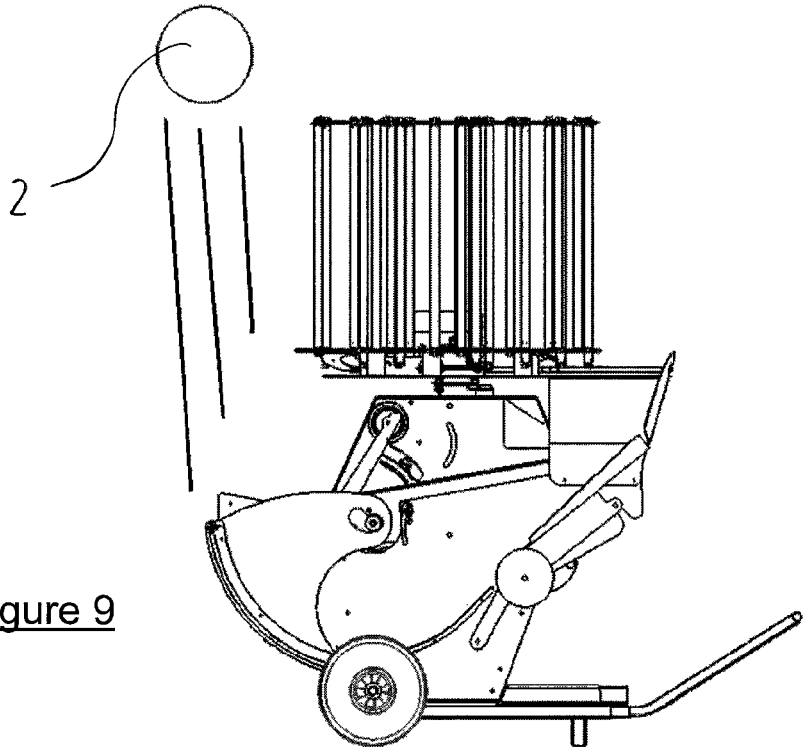

A third example of the relative position of the flap 15 and the base part 13 is shown in FIG. 8 with a flap 15 still raised in a clockwise rotational direction In this configuration, the supporting surface is an arc of circle forming a sector of around 140° to 170°, along which the target 2 bears. Due to the orientation of the flap 15, the launch direction of the target 2 is substantially vertical as shown in FIG. 9.

The range of variation of the supporting surface 12 according to the invention is not limited. Advantageously, the launch direction of the target 2 (ie, the direction of the tangent to the arc of the supporting surface at the downstream end thereof) may vary between the horizontal and the vertical, i.e. in a range of around 90°. It will be understood that this range can cover a large number of possible launches for exercising gun shooters, and archers in particular.

It will also be noted that the flap 15 remains attached to the rest of the device and can be easily adjusted. Thus, the user does not require a long time, or have to perform complex manipulations in order to change the orientation.

It will be noted that the control for adjusting the flap 15 may be motorized in order to automate the entire control assembly of the device. Nevertheless, both the adjustment of the flap 15 or the target loading and launching phases can be carried out entirely manually.

Figure 10:
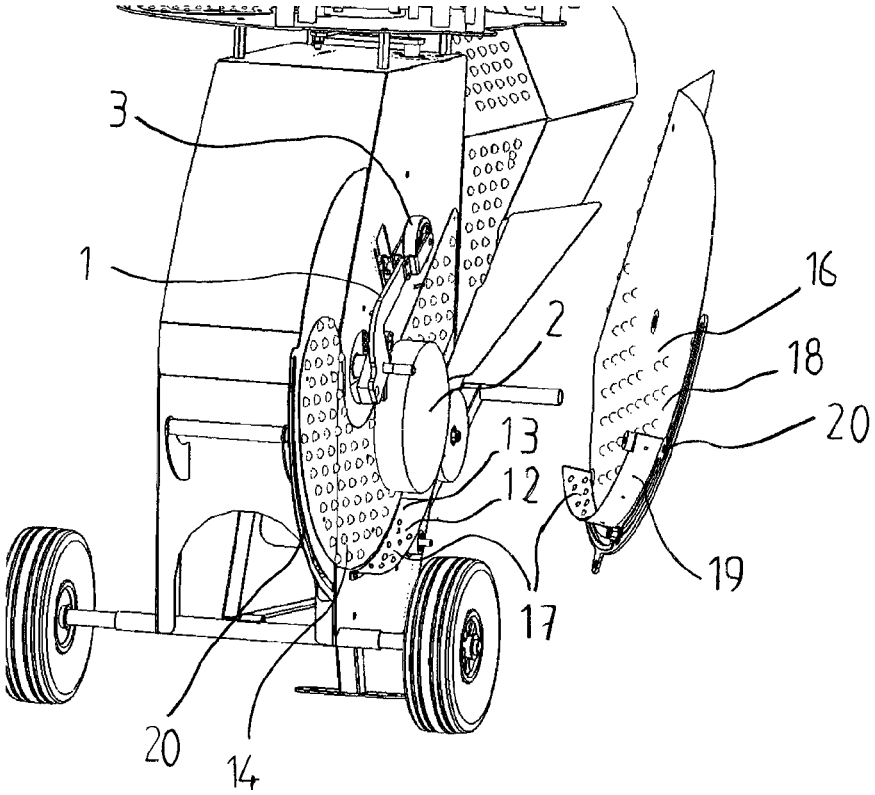
FIG. 10 shows a variant of the invention.

FIG. 10 shows a variant of the flap 15. In this case, the second portion is secured to a support in the form of the carriage 19 shown in the form of a metal section equipped with means for guidance in a slide (20). In an advantageous arrangement, the carriage 19 is guided at each of its ends, both at the level of the base part 13 and at the front, at the level of the sidewall 18 that is substantially parallel to the base part and capable of forming a surface or side 16 establishing contract with one side of the target. The slide 20 is advantageously formed by two openings forming an arc of a circle, one of the openings being on the base part 13, the other on the wall 18. The arc is routed on the rotational axis of the arm 1 in the preferred embodiment. Other means for adjusting the second portion may be provided without exiting the invention.

REFERENCES

1. Launch arm
2. Target
3. Roller
4. Axis of rotation

5. Cylinder
6. Ramp
7. Base
8. Wheel
9. Loading zone
10. Chute
11. Stop
12. Supporting surface
13. Base part
14. Side
15. Flap
16. Side
18. Side wall
19. Carriage
20. Slide

The invention claimed is:

1. A device for launching targets comprising a supporting surface configured for supporting an edge of a target to be launched, and a rotary launch arm configured for applying a launching force to the target, wherein the supporting surface has a concave longitudinal profile in a plane parallel to a rotational plane of the launch arm, the supporting surface comprising a first portion formed on a base part and a second portion formed on a support, the support being adjustable in position relative to the base part, and wherein the first portion and the second portion comprise radially offset overlapping zones, the surface thereof being adjustable for changing a length dimension of the longitudinal profile.

2. The device according to claim 1 wherein the longitudinal profile comprises an arc of a circle.

3. The device according to claim 2 wherein the arc of circle is centered on the axis of rotation of the launch arm.

4. The device according to claim 1, wherein the overlapping zone of the second portion is passing under the overlapping zone of the first portion.

5. The device according to claim 4, wherein the support is adjustable by rotation according to the center of the arc of a circle configured to change the surface of the overlapping zones.

6. The device according to claim 5 wherein the surface of the overlapping zones has a range that corresponds to a modification of an angular sector of between 30° the 90°.

7. The device according to claim 4, wherein the first portion is positioned upstream of the second portion relative to a direction of rotation of the launching arm.

8. The device according to claim 7, wherein a downstream end of the first portion relative to the direction of rotation of the launching arm is configured to define a horizontal tangent to the first portion.

9. The device according to claim 4, wherein the support is a flap.

10. The device according to claim 9, wherein the flap comprises a sidewall normal to the second portion.

11. The device according to claim 4, wherein the support is a carriage mounted adjustably relative to the base part in a slide.

12. The device according to claim 11 wherein the slide comprises one part formed on the base part and another part formed on a side wall that is substantially parallel to the base part.

13. The device according to claim 12 comprising at least one target with circular section, an edge of which is configured so as to be applied to the supporting surface.

14. The device according to claim 13 wherein the target is made of plastic.

15. The device according to claim 12, wherein the supporting surface is of a width that is equal or larger than a width dimension of the target.

16. The device according to claim 1, wherein the base part comprises a side configured for contacting a first side of a target, and wherein the support comprises a side configured for contacting a second side of a target, said second side being opposite to the first side.

* * * * *